US011504935B2

(12) United States Patent
Olmos

(10) Patent No.: US 11,504,935 B2
(45) Date of Patent: Nov. 22, 2022

(54) MACHINE FOR FORMING CARDBOARD BOXES FROM FLAT PLATES

(71) Applicant: TELESFORO GONZALEZ MAQUINARIA S. L. U., Elche (ES)

(72) Inventor: Telesforo Gonzalez Olmos, Alicante (ES)

(73) Assignee: TELESFORO GONZALEZ MAQUINARIA S.L.U., Elche (ES)

( * ) Notice: Subject to any disclaimer, the term of this patent is extended or adjusted under 35 U.S.C. 154(b) by 0 days.

(21) Appl. No.: 17/544,310

(22) Filed: Dec. 7, 2021

(65) Prior Publication Data

US 2022/0184912 A1 Jun. 16, 2022

(30) Foreign Application Priority Data

Dec. 16, 2020 (ES) ..... ES202031259

(51) Int. Cl.

| | |
|---|---|
| ***B31B 50/02*** | (2017.01) |
| ***B31B 50/07*** | (2017.01) |
| ***B31B 50/28*** | (2017.01) |
| ***B31B 50/62*** | (2017.01) |
| ***B31B 50/00*** | (2017.01) |
| ***B31B 50/98*** | (2017.01) |

(52) U.S. Cl.

CPC ..... *B31B 50/024* (2017.08); *B31B 50/006* (2017.08); *B31B 50/07* (2017.08); *B31B 50/28* (2017.08); *B31B 50/622* (2017.08); *B31B 50/98* (2017.08)

(58) Field of Classification Search

CPC ..... B31B 50/07; B31B 50/622; B31B 50/98; B31B 43/185; B31B 43/305; B31B 43/18; B31B 50/26; B31B 50/59; B31B 50/44

USPC ..... 493/84, 123, 124, 162

See application file for complete search history.

(56) References Cited

U.S. PATENT DOCUMENTS

| | | | | |
|---|---|---|---|---|
| 3,259,030 | A * | 7/1966 | Crathern, III | B31B 50/00 156/216 |
| 4,028,999 | A * | 6/1977 | Lee | B31B 50/005 493/126 |
| 4,441,377 | A * | 4/1984 | Nowacki | B31B 50/26 74/105 |
| 2013/0090221 | A1* | 4/2013 | Green | B31B 50/28 493/162 |
| 2013/0090222 | A1* | 4/2013 | Green | B31B 50/00 493/162 |

* cited by examiner

*Primary Examiner* — Andrew M Tecco
*Assistant Examiner* — Jacob A Smith
(74) *Attorney, Agent, or Firm* — Bay State IP, LLC

(57) ABSTRACT

A machine for forming cardboard boxes (B) from flat plates (P), which comprises a feeder of plates with a loader of plates, a sucker mechanism and a conveyor of plates; and a box forming station with a male device with a first rotary electric motor coupled to a first rotational monitoring device, and a male vertically insertable in a mold to form the boxes (B). A pusher member of the conveyor and a suction head of the suction mechanism are both movable by a same second rotary electric motor coupled to a second rotational monitoring device. The first rotary electric motor (11), the second rotary electric motor, the first rotational monitoring device and the second rotational monitoring device are jointly configured to controllably move the male independently of the controlled and synchronized movement of the pusher member and the suction head.

20 Claims, 7 Drawing Sheets

MACHINE FOR FORMING CARDBOARD BOXES FROM FLAT PLATES

CROSS REFERENCE OF RELATED APPLICATIONS

This application takes priority and claims the benefit of Spanish Patent Application No. P202031259 filed on Dec. 16, 2020, the contents of which are herein incorporated by reference.

TECHNICAL FIELD

The present invention relates to a machine for forming cardboard boxes from flat plates.

Throughout this description, the material of the flat plates or sheets with which the boxes are obtained is corrugated cardboard, compact cardboard, and/or the like. These plates have a certain bending stiffness and have weakened lines to facilitate folding of parts of the plate around these weakened lines, and thus forming a box, joining portions of the plates with others, preferably by gluing.

Technical Problem to be Solved and State of the Art

The technical problem to be solved is obtaining a machine for the formation of cardboard boxes from flat plates, with a high productive speed, and of simple and efficient automation. It would be desirable to increase to speeds of several thousand or even tens of thousands of boxes formed per hour.

The cardboard boxes obtainable with said machine provide an advantageous reduced time of biodegradation against plastic or metallic materials. Cardboard is more attractive in terms of environmental sustainability.

Since the invention relates to a machine for the production of boxes specifically made of cardboard, the machine requires to be specifically adapted to the particular mechanical characteristics of a cardboard sheet, for example: compressive strength, flexural strength, buckling, and deformation thereof, among others.

Document US201437442A1 explains that machines used to form aluminum boxes by molding cannot be used to form cardboard boxes by molding because cardboard is not as malleable and ductile as aluminum; if cardboard is fed into an apparatus for molding aluminum boxes, cardboard would tear and/or break, thereby preventing obtaining the box by the specific configuration of the elements integrating the machine or apparatus. In this sense, documents BE603605A and US2925758A can also be mentioned.

In order to increase speed of formation, documents US3176978A, US4861325A, ES2081235A2 and ES2739389A1 disclose respective box forming machines with respective feeders of plates, each of which comprises:

- a loader of plates with two lateral guides one located on each side of the plates which are capable of being supported, configured to support these plates with the faces thereof vertically or with an inclination with respect to the vertical; and
- a sucker mechanism which comprises a suction head with at least one sucking element configured to hold the plate, said suction head being movable between a first position, wherein it is capable of individually suctioning sheets supported in the loader by one of the faces thereof, and a second position, wherein it is capable to position the plate horizontally supported with that same face oriented upwards.

In documents ES2081235A2 and ES2739389A1, the plates in the second position are further positioned in a conveyor of plates. Document ES2739389A1 is considered the closest document of the state of the art.

However, the machine of document ES2739389A1 is limited in terms of maximum productive speed at about between 1,200 and 2,000 boxes per hour, since the machine is differentially designed by means of a guide and conjugate guide 29, 31 of a vertical type feeder in order to offer an ergonomic load of flat plates with a relatively large surface.

EXPLANATION OF THE INVENTION

In order to overcome the above exposed and other drawbacks, the present invention presents a machine for forming cardboard boxes from flat plates.

The machine comprises a feeder of plates and a box forming station.

The feeder of plates comprises:

- a loader of plates with two lateral guides, one located on each side of the plates capable of being supported, the loader being configured to support these plates with its faces vertically or with an inclination with respect to the vertical;
- a sucker mechanism which comprises a suction head with at least one sucking element configured to hold the plate, said suction head being movable between a first position, wherein said suction head is capable of individually holding by suction the plates supported on the loader by one of the faces thereof, and a second position, wherein said suction head is capable of positioning the plate supported on two horizontal lateral guides of plates of a conveyor of plates with that same face hold by suction oriented upwards; and
- said conveyor of plates, which further comprises a pusher member horizontally movable between the two horizontal lateral guides, these two horizontal lateral guides and said pusher member being configured to transport horizontally and in a guided manner the plates, one by one, from the second position, towards a third position, wherein the plates are aligned vertically and arranged between a male and a mold of a box forming station.

The box forming station comprises:

- a male device which comprises a first rotary electric motor, operatively coupled to a first rotational monitoring device configured to directly or indirectly monitor an angle rotated by the first rotary electric motor, the male device being configured to controllably and vertically move at least one male of the aforementioned in opposite directions of insertion and extraction with respect to a cavity of said mold;
- said at least one male of the aforementioned provided with a lower base of pressure configured to press the base of the flat plate located in the third position into the cavity; and
- said mold which includes said cavity, and a plurality of folding devices delimiting a perimeter of the cavity and providing to the latter a shape complementary to the base of the box to be formed, wherein the male is insertable to fold and join portions of the plate with others and form one of said boxes.

The pusher member of the conveyor of plates and the suction head of the sucker mechanism are both movable by a same second rotary electric motor of the machine, this second rotary electric motor being operatively coupled to a second rotational monitoring device configured to directly or indirectly monitor an angle rotated by the second rotary electric motor.

In the direct monitoring, the rotational monitoring device is configured to monitor the angle rotated by the second electric motor.

In the indirect monitoring, the rotational monitoring device is configured to monitor an angle rotated by a shaft movable by the second electric motor, thereby monitoring the angle rotated by the second electric motor.

The first and second rotary electric motors and the first and second rotational monitoring devices are jointly configured to controllably move the male, independently of the controlled and synchronized movement of the pusher member and the suction head.

Optionally, the first and/or second rotary electric motors may be embodied in conventional electric motors or in motors which form an integral part of respective servomotors (servo driven motors), or a combination of these options, among others. By "rotational monitoring device", it will be understood in this specification any device of monitored reading, in particular associated with a shaft of a rotary electric motor, which provides a response indicative of the rotational movement imparted by said motor, by an electrical signal that can be read by some type of controller device in a motion control device, such as a programmable logic controller (PLC) or computer.

In another option, the first and/or second rotational monitoring device may be embodied in a detector of the motor rotational motion, for example of the inductive type, or in a rotational encoder (encoder) which monitors said motion and which forms an integral part of a servomotor.

In order to solve the technical problem, the present invention proposes providing the machine with a specific sucker mechanism and conveyor of plates which allow a high number of cycles per unit of time, together with a particular solution of box forming station, which comprises said male device with a rotating electric motor operatively coupled to a rotational monitoring device, and said male and said mold.

This solution of sucker mechanism is especially useful for increasing productive speed, making independent the movement of the suction head from the movement of the conveyor in the feeder of the machine, since the plate and the suction head are above the guides of the conveyor at all positions of movement of the suction head.

The horizontal lateral guides of plates and pusher member of the conveyor also substantially improve the productive speed of boxes, as with the horizontal lateral guides of plates the male can be moved in the direction of insertion into the cavity of the mold although the suction head is positioned in the third position of delivery, thus contributing to make independent the movements between the sucker mechanism and male, all resulting in an improvement in the speed of box formation.

In the machine of said document US4861325A, the suction head positions a plate from said first position directly in a position where the plate is aligned vertically and arranged between a male and a mold. This machine lacks these horizontal lateral guides of plates and the transition area that they provide, and disadvantageously, this machine cannot make independent the movements of the sucker mechanism and male, with the male being expected to wait for the suction head to be removed to be inserted into the cavity of the mold, limiting severely the speed of formation.

The present invention proposes the machine to be further configured with a single drive point for moving both the pusher member of the conveyor of plates and the suction head of the sucker mechanism.

This drive point is the second rotary electric motor and its movement is controlled by a second rotational monitoring device. This configuration provides greater precision and accuracy in the movements of these elements, enabling high speeds against a pneumatic driving solution, for example, one based on pneumatic cylinders.

The present invention further proposes that, in the machine, the controlled movement of the male provided by the assembly of the first rotary motor and the first rotational monitoring device is independent of the controlled and synchronized movement provided by the assembly of the second electric motor and the second rotational monitoring device configured to move the pusher member and suction head.

Thus, advantageously, the male can be moved or stopped at will with respect to the movement of the pusher member and the suction head, or vice versa, adapting the machine for the formation of a wide variety of boxes at a high formation speed, and in a simple and efficient manner.

The present invention proposes a specific number of rotary electric motors in the box forming machine: a motor for moving the male (first rotary motor), and another motor for moving the suction head and pusher member (second rotary motor), which is especially advantageous for a high productive speed, and provides a simple and efficient automation of the machine.

On the one hand, the solution of the present invention is very advantageous in terms of maximum production speed against prior art box forming machines, wherein the male, the conveyor and the sucker mechanism of the machine are all moved or stopped at a time by a common rotary electric motor (single drive point). Disadvantageously, this prior art machine with a single rotating electric motor has an undesired excessive inertia, since this motor must move a large number of elements of considerable dimensions and weights, limiting the maximum productive speed to about between 2,500 or 3,500 boxes per hour.

On the other hand, the machine with three rotary electric motors of said document ES2739389A1, with a first motor for the male, a second motor for the conveyor, and a third motor for the sucker mechanism, tends to exhibit movement desynchronizations between these three motors against the increase of the productive speed, and this desynchronization is severe above 3,000 boxes per hour and especially severe between 4,000 and 6,000 boxes per hour. These desynchronizations cause the machine to stop and/or not to form boxes properly, whereby the productive speed of well-formed boxes decreases significantly. Additionally, the automation, adjustment and handling of this solution is more complex at these high productive speeds.

Preferably, the machine of this invention is designed to enable the formation of relatively small plate dimensions, typically comprised in the range of 0.15 to 0.55 m in width and 0.15 and 0.6 m in length, forming relatively small base boxes, even of 0.07 m in width and length. The lower the plate and box dimensions, the greater the speed of box formation can be. These low values of plate and box obtainable with the machine of the present invention are very lower than those of document E2739389A1, wherein the plates can be of the order of 1.5 m in width by 1.5 m in length.

Preferably, in the machine of the present invention:

the male has a plurality of side faces with inclinations with respect to the vertical direction and converging towards the lower base, each of these side faces being configured to fold a respective side panel of the plate;

the machine further comprises at least one glue injector, configured to deposit glue cords parallel to each other on the flat plate during the horizontal movement of the pusher member, to join the parts of the plate with others by gluing;

the second rotational monitoring device includes a rotational encoder; and the machine has further associated a box nesting device, configured to insert a box, previously folded by said side faces and said folding devices, inside another, to contact the flat side walls of a box with those of others, and configured to, by this contact of flat side walls, press the glue cords previously applied by the at least one glue injector to reinforce the glue joint of the side walls which laterally surround the base thereof, the lateral walls including the folded side panels.

The inclinations of the side faces of the male provide the male with an essentially inverted truncated pyramid shape, wherein the edges thereof may optionally be chamfered to form additional chamfered side walls of the box, determining a male of eight or twelve side faces. These inclinations of the side walls of the boxes allow the boxes to be insertable one into others with side walls thereof in contact.

Preferably, as described above, the machine comprises a box nesting device for the purpose of nesting boxes forming stacks, and for pressing the glue previously deposited by the at least one glue injector, which is preferably pressurizable and heatable by pressure and heating devices, respectively, and the at least one glue injector is further activatable to inject glue by at least one solenoid valve, and thus assisting in the join by gluing of the side walls of the box, which can comprise folded side panels and optionally glue joined side flaps.

These inclinations of the side faces of the male, the rotational encoder, the at least one glue injector, and the box nesting device allow together to increase the speed of formation of the machine, since the necessary time for the male to be in the inserted position is minimal, thanks to the box nesting device which allows the glue previously applied to form the side walls to extend and dry therein in the stack of boxes while the male simultaneously forms boxes of subsequent cycles.

The rotational encoder of the second monitoring device and the particular glue application technology by the at least one glue injector provide accuracy and precision for the deposition of the glue on the plate although the conveying speed is increased to produce between 4,000 and 6,000 boxes each hour. Preferably, in the machine, the first and second rotary electric motors, first and second rotational monitoring devices, and the at least one glue injector are connected to a programmable controller device of the machine.

In the present invention, the term "controller device" comprises the terms "micro-controller", "controller", "programmable automaton", "control system", "control unit", "programmable logic controller", "processor", "microprocessor", and "computer", among others.

The term "connected" comprises to connect directly or indirectly two elements via a wireless connection or by control signal cables, which may be, for example, communications buses, or multi-wired cables or single-wired cables, fiber optic or ethernet cables, for example, "ether-CAT®".

This machine configuration, with the activatable and/or movable elements connected to a programmable controller device of the machine, causes the latter to maintain high formation speeds by synchronizing male, sucker mechanism, conveyor, and at least one glue injector, even upon the precision requirement to which the at least one glue injector is subjected.

Optionally, in the machine, the mold further comprises fluid-dynamic cylinders connected to the programmable controller device and configured to move, each of them, a respective box forming member of the mold, independently of the movements provided by the first and second rotary electric motor.

Here the movement of the forming members is independent of the rest of movements the machine, which is very advantageous for relative high forming speeds, and particularly beneficial in combination with the independence of movement of the male, with respect to the synchronized movement of the sucker mechanism and conveyor mechanism of the feeder, by the single second rotary electric motor.

Preferably, the machine further comprises another loader of plates, and another male corresponding to another mold, one mold being associated with each male, in the box forming station. These loaders, molds and males are supported on a same chassis of the machine.

In this option, the sucker mechanism further comprises another suction head, each of said two suction heads is movable between respective first positions and second positions, and each of said two suction heads is capable of individually suctioning plates supported on a respective loader and positioning the plate supported on said two horizontal lateral guides of plates and on another two horizontal lateral guides of plates of the conveyor of plates, respectively.

Also, in this option, the conveyor of plates comprises said four horizontal lateral guides and said pusher member and another pusher member, each of the two pusher members being movable between a respective pair of said horizontal lateral guides, each pair of horizontal lateral guides and pusher member associated with these being configured to transport horizontally and in a guided manner the plates, one by one, from the second position, towards the third position wherein each of the plates is vertically aligned and arranged between one of said two males and one of said two molds, correspondingly.

Thus, in this option the machine speed of formation is increased, in a simple and efficient manner, without increasing the complexity in the automation of the machine, both at the level of the machine program and at the level of usage and workability thereof.

Thus, in this option of the present invention, the machine can produce at a speed between 8,000 and 12,000 boxes per hour, this is, between 4,000 and 6,000 boxes per hour at each of the two forming stations.

The present invention expressly covers a greater number of loaders and forming stations.

In an alternative embodiment, each male device can be moved by a respective male device. These male devices have already been described above. That is, each of these male devices comprises a respective first rotary electric motor operatively coupled to a respective first rotational monitoring device configured to directly or indirectly monitor a respective angle rotated by the respective first electric motor, each respective male device being configured to controllably and vertically move at least one respective male in opposite directions of insertion and extraction from a respective cavity of a respective mold.

Preferably, in the machine, the loader is configured to support the plates with faces thereof with an inclination with respect to the vertical direction comprised between 10 and 30 degrees.

This inclination is especially designed so that the aforementioned movement of the suction head between the first and second positions is as fast as possible thanks to the short distance between the first and second positions, thus increasing the speed for feeding the plate, and the speed between forming cycles of the machine.

Preferably, the value of this inclination of the loader is comprised between 15 and 25 degrees.

Optionally, in the sucker mechanism, the second rotary electric motor is configured to cause a rotation of at least one articulated bar around at least one horizontal articulation, and said articulated bar is, in turn, configured to cause a rotation of an inverted bar around a second horizontal articulation. Each of the aforementioned horizontal articulations may or may not modify its position during its rotational movement. For example, an articulation may be supported at a fixed structural point of the chassis, or may be supported at a point movable in translation and/or rotation about a fixed structural point of the chassis.

Optionally, in the machine, the conveyor of plates comprises a connecting rod directly or indirectly coupled at a proximal end thereof to the second rotary motor, and a horizontal guiding device is connected to a distal end of said connecting rod, said connecting rod and said horizontal guiding device being configured to cause a forward and backward guiding of said pusher member between the second and third positions.

Optionally, the male device comprises two vertical linear guides fixed at a structural point of a chassis of the machine, and at least one guide block with capability for sliding in each vertical linear guide and fixed to a carriage capable of sliding along the vertical linear guides.

This male device further comprises said carriage, wherein at least one vertical member is fixed, the at least one vertical member supporting at a lower end thereof said male and a horizontal transverse guide mounted on the carriage.

Also, this male device comprises a rotary crank provided with a proximal end and a distal end, directly or indirectly joined by the proximal end thereof to the first rotary electric motor, and pivotally joined by the distal end thereof in an articulation to an additional guide block capable to slide in the transverse guide.

A BRIEF DESCRIPTION OF THE DRAWINGS

To complement the description that is being made of the object of the present invention and to help to better understanding of the characteristics that distinguish it, it is accompanied in the present descriptive specification, as an integral part thereof, a set of plans, in which, for illustrative and not limiting purposes, the following has been represented:

DETAILED DISCLOSURE OF THE EMBODIMENTS

Figure 1:
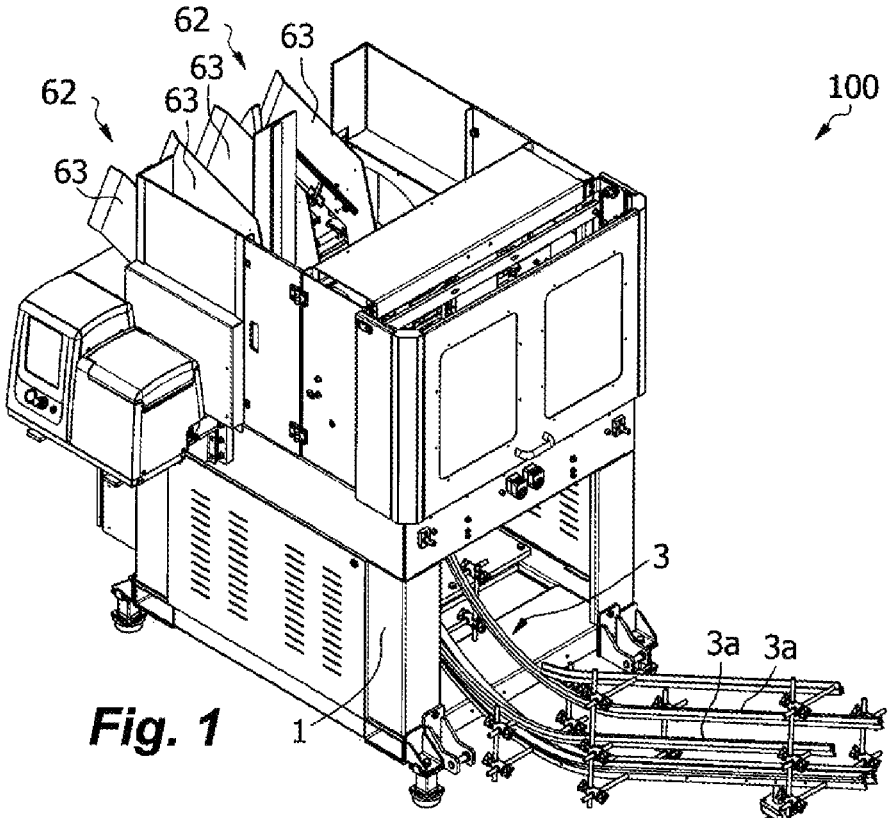
FIG. 1 is a front top perspective view of a first embodiment of the box forming machine of the present invention.

According to the first embodiment of the present invention, FIGS. 1, 2, 7*a*, 9 and 14 show a machine (B) for forming cardboard boxes (B) from flat plates (P) comprising a feeder of plates and a box forming station.

The feeder of plates comprises two loaders (62) of plates, a sucker mechanism (99) of plates and a conveyor of plates. The box forming station comprises a male device (10) configured to move two males (6) vertically, in opposite directions of insertion and extraction into respective molds (50) for the formation of boxes (B).

In an alternative embodiment, (not shown) each male (10) can be moved by a respective male device (10).

Figure 2:
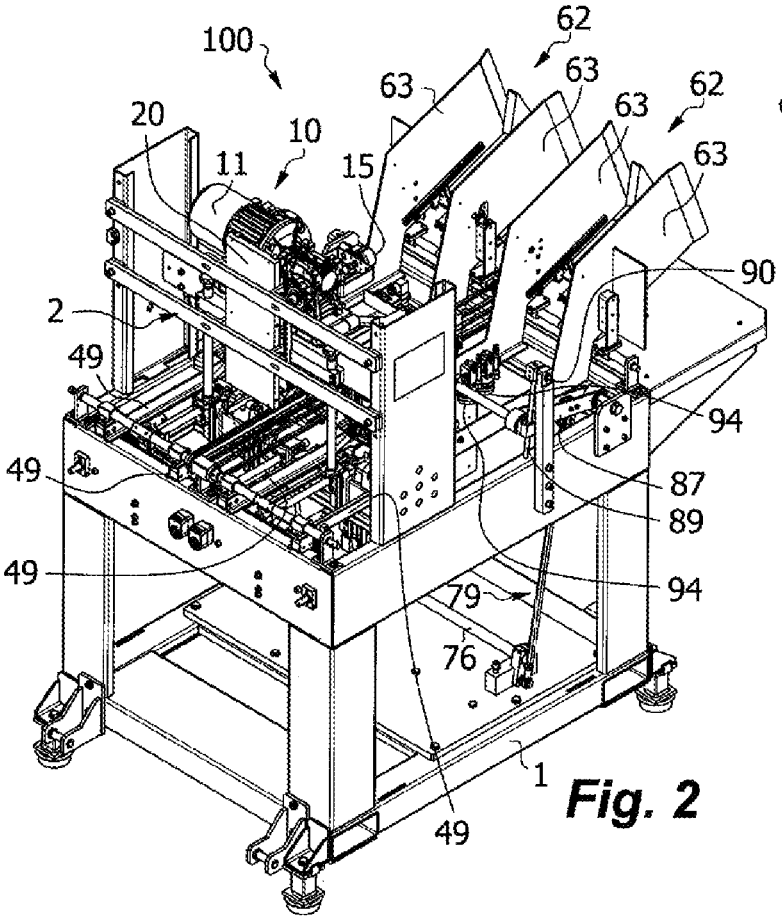
FIG. 2 is another front top perspective view of the machine of FIG. 1, wherein some elements have been omitted for better visualization of the interior of the machine.
Figure 6:
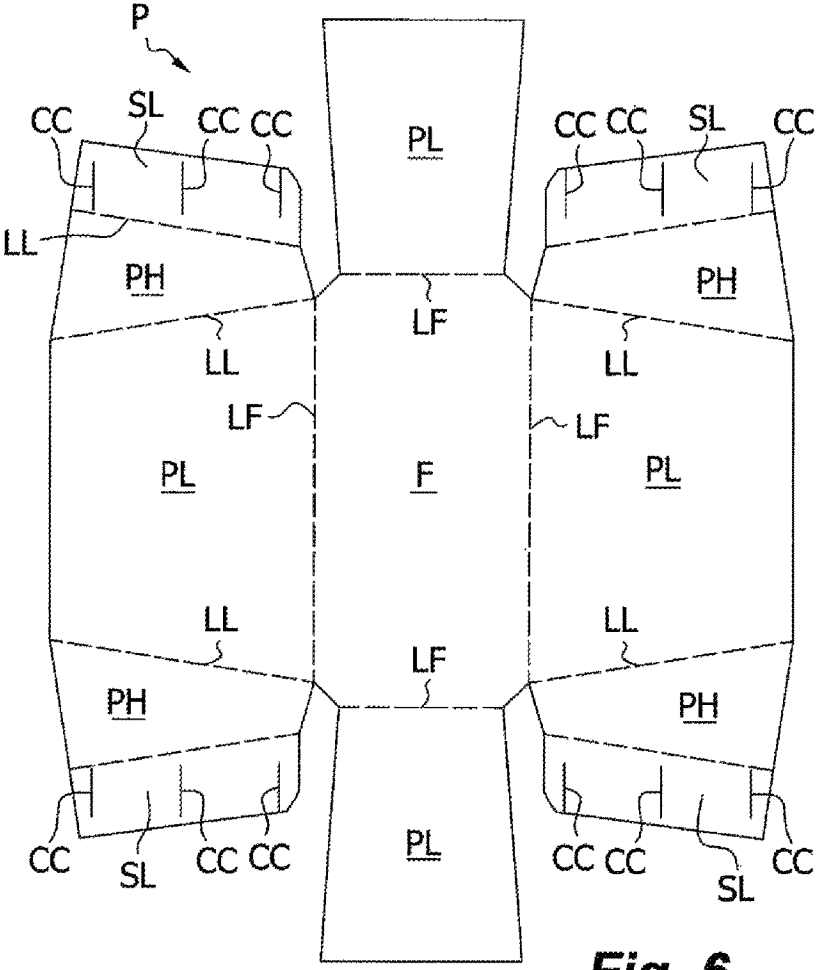
FIG. 6 is the plate from which the box of FIG. 4 is obtained.
Figure 7:
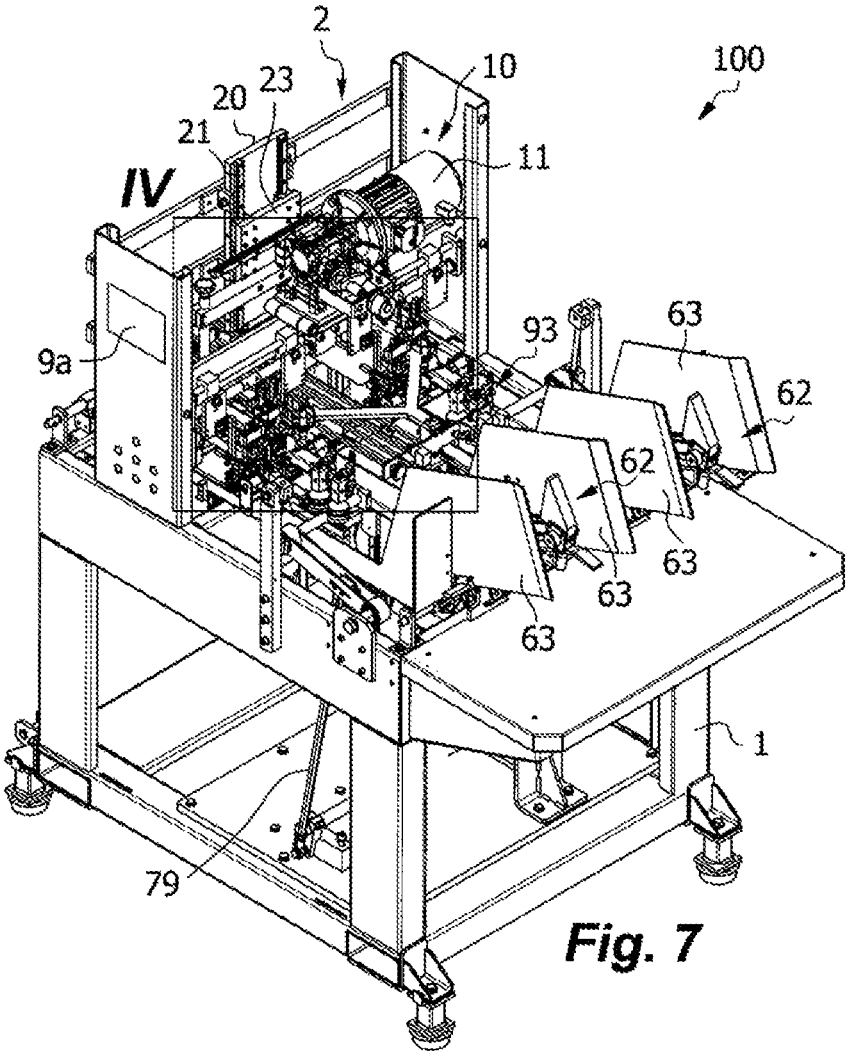
FIG. 7 is a rear top perspective view of the machine of FIG. 2, wherein a detail IV is indicated.

FIGS. 1, 2 and 7 show that the aforementioned loaders (62) and this box forming station are supported on a same chassis (1) of the machine (100). Each of these loaders (62) has two lateral guides (63), one located on each side of the plates (P) which are capable of being supported, such as that shown in FIG. 6. Each of these loaders (62) is further configured to support these plates (P) with faces thereof with an inclination with respect to vertical direction comprised between 10 and 30 degrees.

The plate (P) of FIG. 6 is made of corrugated or compact cardboard, and has an essentially rectangular base (F), preferably with chamfered corners, further delimited by four base lines (LF) mutually parallel two to two, which separate the base (F) from four side panels (PL).

Figure 4:
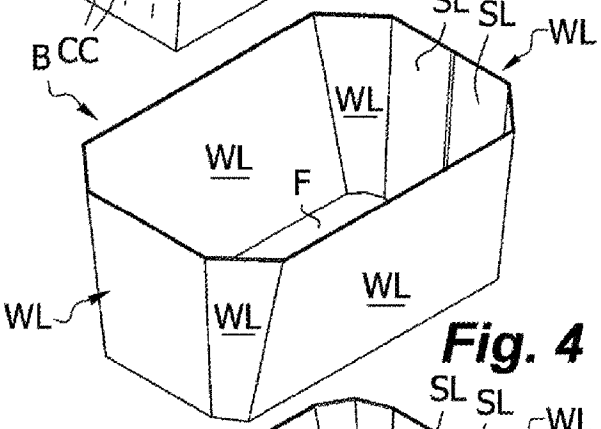

These side panels (PL) have at their lateral extensions four side flaps (SL) arranged to join side panels (PL) of the plate (P) once folded with others and thus form four side walls (WL) of the box (B) of FIG. 4

Figure 5:
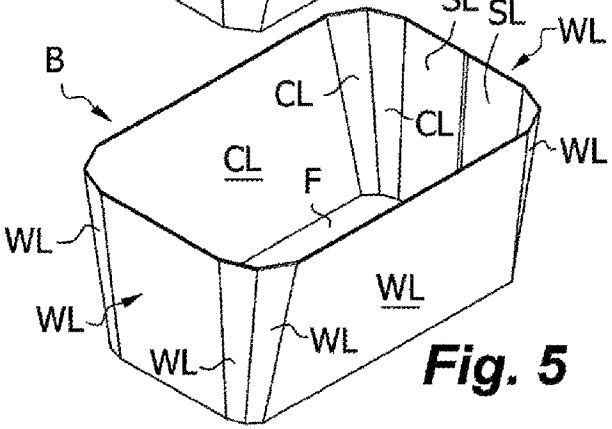

The side panels (PL) have at these lateral extensions one or more optional chamfered panels (PH) that will form optional chamfered side walls (WL) in the formed boxes (B) of FIGS. 4 and 5. These chamfered panels (PH) are, in turn, adjacent to a respective side flap (SL). The box of FIG. 3 has four side walls (WL) and does not have these chamfered side walls (WL).

The machine (100) of this first embodiment is configured to deposit the glue cords (CC) shown on the plate (P) of FIG. 6, to join, on each of the two opposite sides of the plate (P), two respective side flaps (SL) derived from respective ends of side panels (PL) with another respective side panel (PL) and thus form two minor and opposite side walls (WL). The other two major side walls (WL) of the box (B) of FIG. 4 include major side panels (PL) of the plate (P) of FIG. 6.

Figure 3:
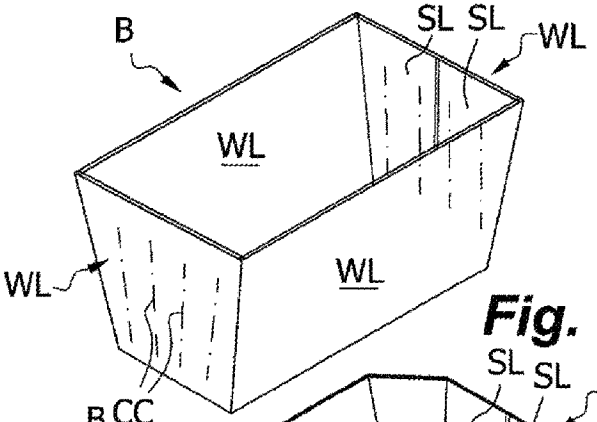
FIGS. 3, 4 and 5 are respective top perspective views of boxes with inclined side walls obtainable with the machine of FIG. 1.

The plates (P) associated with FIGS. 3 to 6 have weakened lines (LF, LL) to facilitate folding parts of the plate (P) around these, and thus forming a box (B), joining portions of the plates (P) with others, by continuous or discontinuous glue cords (CC), shown in phantom lines in FIG. 3 and hidden but also present in the boxes (B) of FIGS. 4 and 5.

In the machine (100), the sucker mechanism (99) comprises two suction heads (93), each of said two suction heads (93) with a plurality of sucking elements (94), embodied in vacuum cups, configured to hold a respective plate (P).

Figure 14:
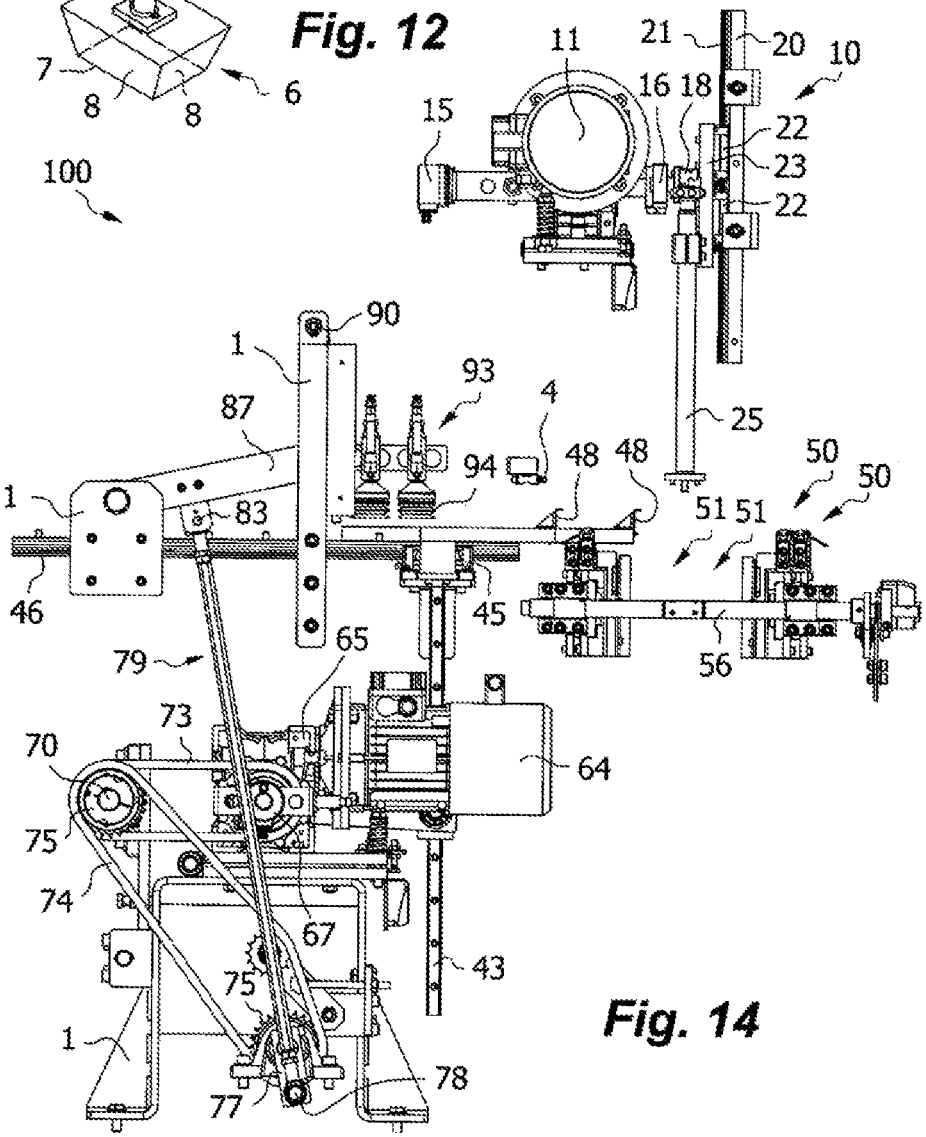
FIG. 14 is a side view of FIG. 9, wherein the at least one glue injector has been further shown.

Each suction head (93) is movable between a respective first position (not shown), wherein each suction head (93) is capable of individually holding by suction plates (P) supported on a respective loader (62) by one of its faces, and a second position shown in FIG. 14, wherein each suction head (93) is capable to position each respective plate (P) supported on a respective pair of horizontal lateral guides (49) of plates of the conveyor of plates with the aforementioned faces of the plate (P) previously sucked oriented upwardly.

In the machine (100), the conveyor of plates comprises four horizontal lateral guides (49) and two pusher members (48), each pusher member (48) being movable between a respective pair of horizontal lateral guides (49).

Each pair of horizontal lateral guides (49) and pusher member (48) associated with these is configured to transport horizontally and in a guided manner the plates (P), one by one, from the second position, towards the third position wherein the plates (P) are vertically aligned and arranged below the corresponding male (6) in a extracted position and above the corresponding mold (50).

FIGS. 9 and 12 to 14 show that the male device (10) comprises a conventional first rotary electric motor (11), operatively coupled to a first rotational monitoring device (15), configured to indirectly monitor the angle rotated by the first rotary electric motor (11) through direct monitoring of the angle rotated by a movable shaft of a first gearbox (12) coupled to the first rotary electric motor (11). FIGS. 9 and 10 to 15 show that this first rotational monitoring device (15) is a rotational encoder.

Thus, the male device (10) is configured to controllably and vertically move the two males (6) in opposite directions of insertion and extraction with respect to the respective cavities (51) of the molds (50).

FIGS. 9 and 12 to 14 show that the male device (10) comprises two vertical linear guides (21) fixed at a structural point of the chassis (1) of the machine (100), such as a fixed plate (20) mounted on an upper bridge (2) of the chassis (1) arranged above the horizontal lateral guides (49) and the cavity (51).

This male device (10) further comprises two guide blocks (22) capable of sliding in each vertical linear guide (21) and fixed on a carriage (23) capable to slide along the vertical linear guides (21).

The male device (10) further comprises said carriage (23), wherein two vertical members (25) are fixed, and the two vertical members (25) support at its lower end one of said males (6) each.

At the lower end of one vertical member (25) is supported one of said males (6) with the configuration of four inclined side faces (8) which can form the box of FIG. 3.

At the lower end of the other vertical member (25) is supported the other said male (6) with a configuration of eight inclined side faces (8) which can form the box (B) of FIG. 4.

Thus, the machine (100) is configured for the formation of boxes (B) of different and/or identical shapes, sizes and/or formats at a time.

The male device (10) further comprises a horizontal transverse guide (19) mounted on the carriage (23), and a rotating crank (16) provided with proximal and distal ends.

The crank (16) is joined indirectly by the proximal end thereof to the first rotary motor (11) by the first gearbox (65), and pivotally joined at the distal end thereof to an articulation (17) to an additional guide block (18) capable to slide in the horizontal transverse guide (19).

Figure 12:
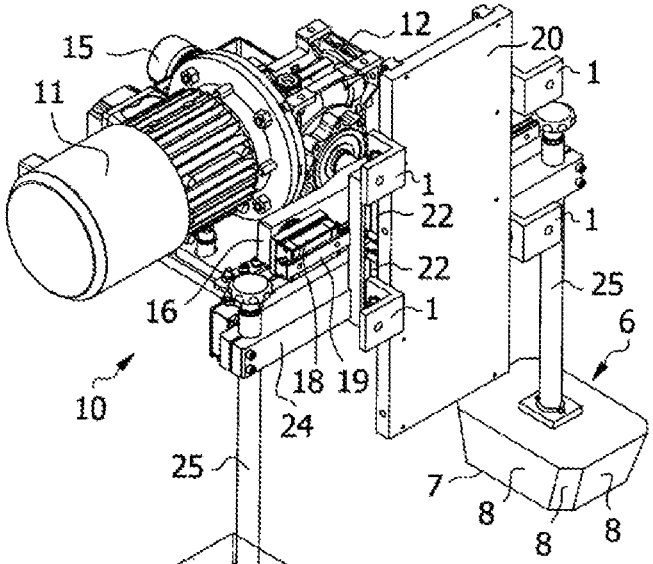
FIG. 12 is a front top perspective view of the male device of FIG. 9 and wherein a male has been shown schematically in each vertical member.
Figure 13:
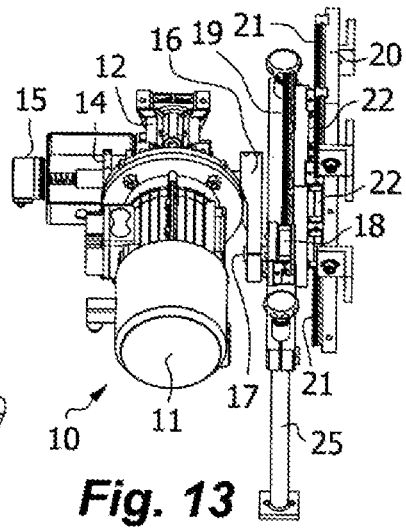
FIG. 13 is a side top perspective view of the male device of FIG. 12.

Following in FIG. 12, each of the two males (6) is provided with a lower base (7) of pressure configured to press the base (F) of the flat plate (P) located in the third position into the cavity (51). Each of these males (6) has a plurality of side faces (8) with inclinations with respect to the vertical and converging towards the lower base (7), each of these side faces (8) being configured to fold a respective flat side panel (PL) of the box (B) from the flat plate (P).

Figure 9:
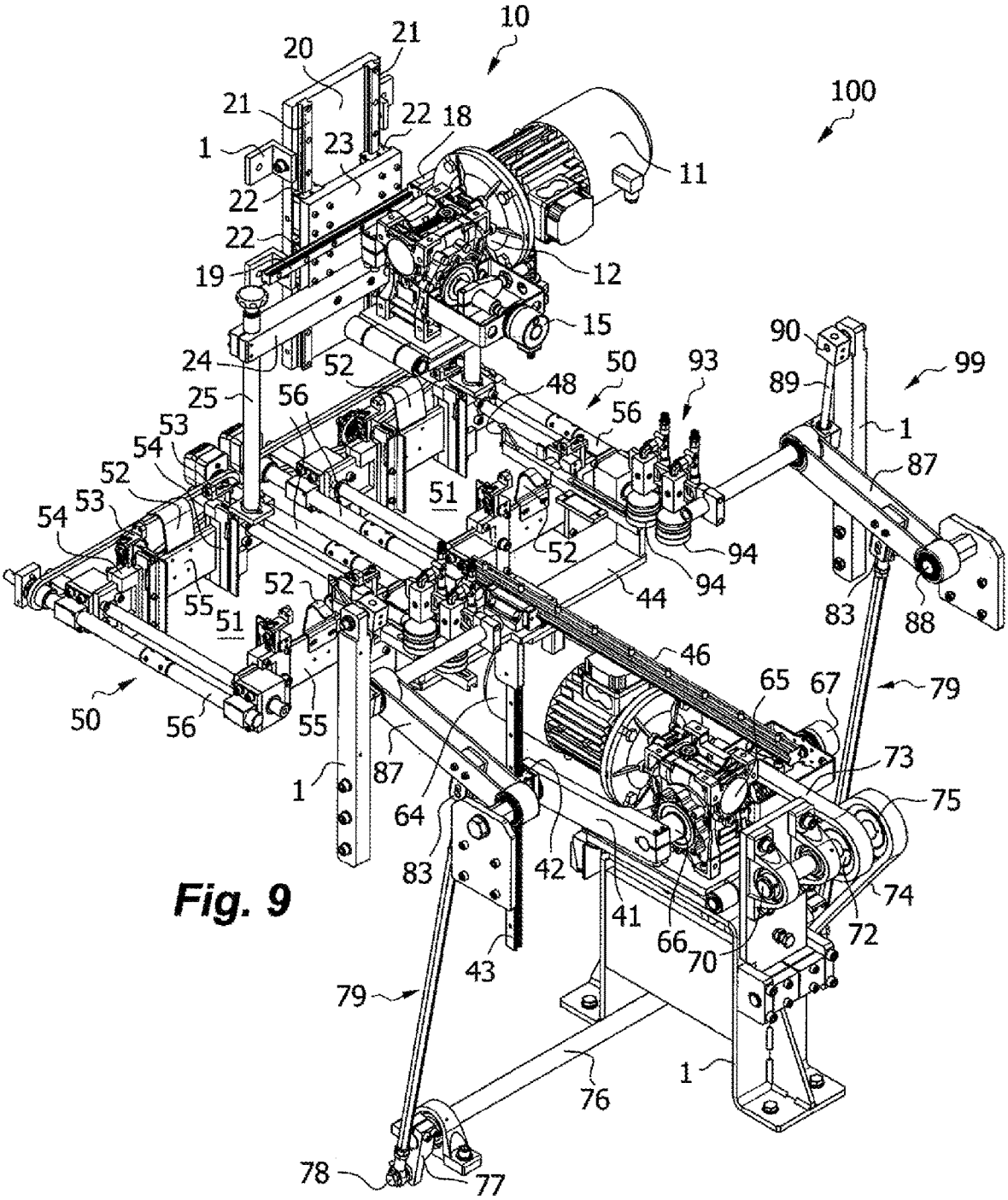
FIG. 9 is a rear top perspective view of the feeder and box forming station of the machine of FIG. 7.
Figure 11:
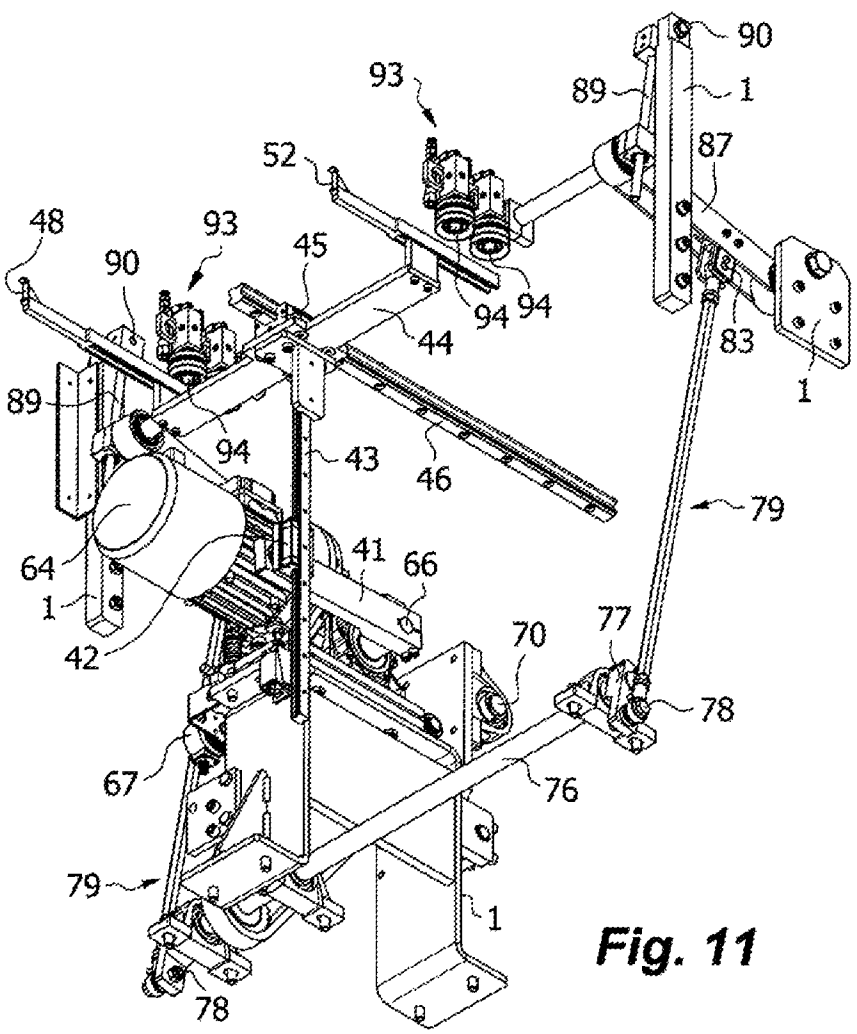
FIGS. 10 and 11 are views of the sucker mechanism and of some parts of the conveyor of the machine, according to a rear top view and a front bottom view, respectively.
Figure 10:
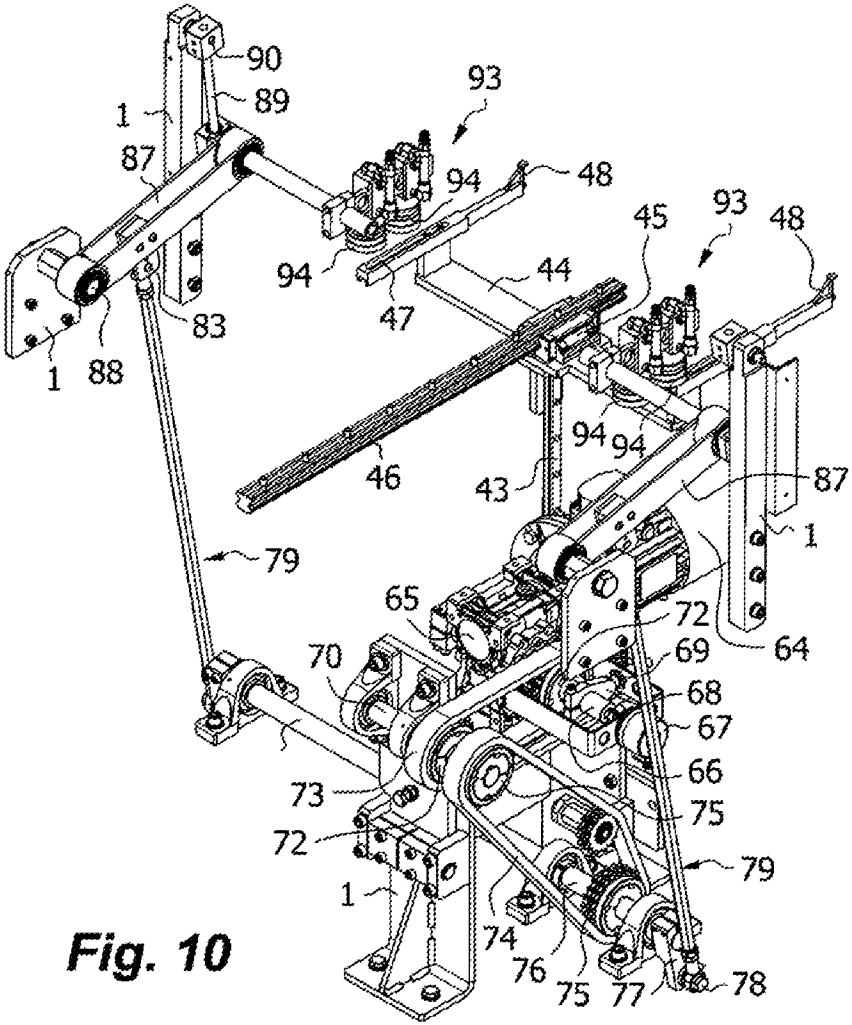

Each of the two molds (50) of FIG. 9 includes a cavity (51), wherein the male (6) is insertable to fold and join portions of the plate (P) with others and form a box (B), and has a plurality of folding devices(52, 53) defining a perimeter of its cavity (51), providing the cavity (51) with a shape complementary to the base (F) of the corresponding box (B) to be formed.

FIGS. 9 to 11 and 14 show that the two pusher members (48) of the conveyor of plates and the two suction heads (93) of the sucker mechanism (99) are all movable by a same second rotary electric motor (64) of the machine (100).

This second rotary electric motor (64) is operatively coupled to a second rotational monitoring device (67), configured to monitor indirectly, through the rotation of the shaft (66) of the secondary gearbox (65), the angle rotated by the second rotary electric motor (64). The second rotational monitoring device (67) includes a rotational encoder, and further an inductive type detector (69) for monitoring indirectly, through the rotation of a cam (68) coupled to the shaft (66) of the second gearbox (65), the angle rotated by the second rotary electric motor (64).

FIGS. 9 to 11 and 14 show that, in the machine (100), the first and second rotary electric motors (11, 64), and the first and second rotational monitoring devices (15, 67) are jointly configured to controllably move the two males (6) of the forming station, independently of the controlled and synchronized movement of the two pusher members (48) and of the two suction heads (93).

In the sucker mechanism (99), the second rotary electric motor (64) and the secondary gearbox (65) coupled to the second rotary motor (64), are configured to cause a rotation of two articulated bars (87) around respective horizontal articulations (88). Each one of these articulated bars (87) is configured, in turn, to cause a rotation of a respective inverted bar (89) around a respective second horizontal articulation (90).

Each articulated bar (87) is movable by the action of a respective pivoting bar (79) around a lower fourth articulation (78) of connection with a respective lever (77), being this in turn movable by a horizontal secondary driven shaft (76). The upper end of the pivoting bar (79) is articulated with respect to the articulated bar (87) in an upper fifth articulation (83). This secondary driven shaft (76) is movable by a primary driven shaft (70) and a secondary link chain (74) mounted on two secondary sprockets (75), one fixed on each shaft (75, 76), and capable of transmitting the movement of the primary driven shaft (70) to the secondary (76).

The output shaft (66) of the secondary gearbox (65) movable by the second rotary electric motor (64) is configured to transmit the movement to the primary driven shaft (70) by a primary link chain (73) mounted on two primary sprockets (72), one fixed on each shaft (66, 70).

In the machine (100), the conveyor of plates comprises a connecting rod (41) indirectly coupled, through the secondary gearbox (65) and at the proximal end thereof, to the second rotary electric motor (64).

The conveyor of plates further includes a horizontal guiding device (45, 46) connected to a distal end of said connecting rod (41), said connecting rod (41) and said horizontal guiding device (45, 46) being configured to cause a forward and backward guiding of the two pusher members (48) between their respective second and third positions.

This horizontal guiding device (45, 46) comprises a horizontal linear guide (46) and a conveyor guide block (45) coupled to the horizontal linear guide (46).

At the distal end of the connecting rod (41), a primary guide block (42) is pivotally and sliding connected, the primary guide block (42) is, in turn, coupled to a second inverted bar (43), which is directly or indirectly joined in a fixed manner at the upper end thereof, to a guide support (44), in which the two pusher members (48) are mounted.

Figure 8:
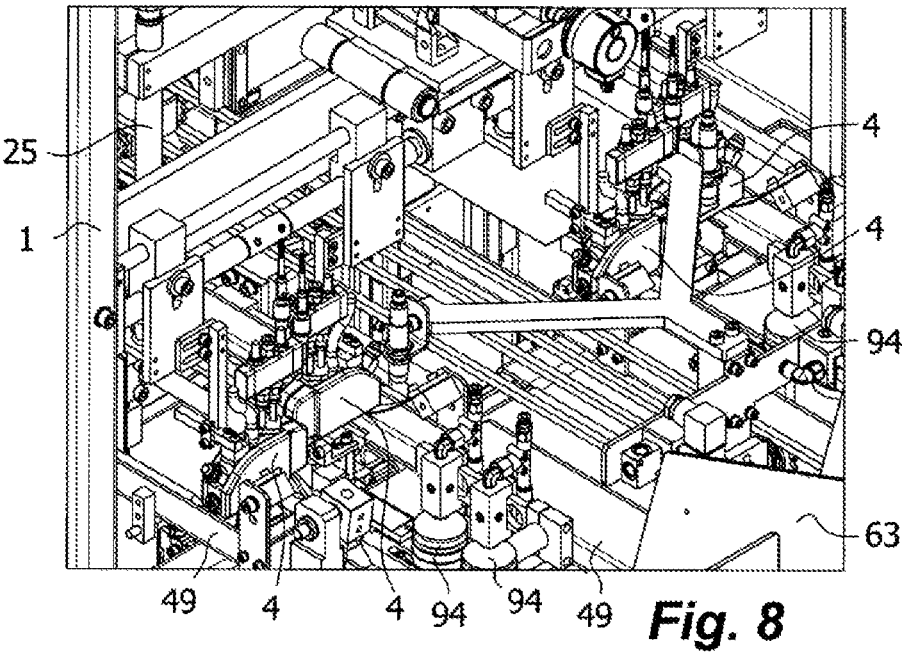
FIG. 8 is the detail view IV of FIG. 7.

FIGS. 8 and 14 show that the machine (100) further comprises two glue injectors (4) suspended on each pair of horizontal lateral guides (49), thus having the machine (100) a total of four glue injectors (4). Each pair of glue injectors (4) are configured to deposit glue cords (CC) parallel to each other on each respective flat plate (P) during the horizontal movement of a respective pusher member (48), for joining portions of the plates (P) with others by gluing.

Figure 15:
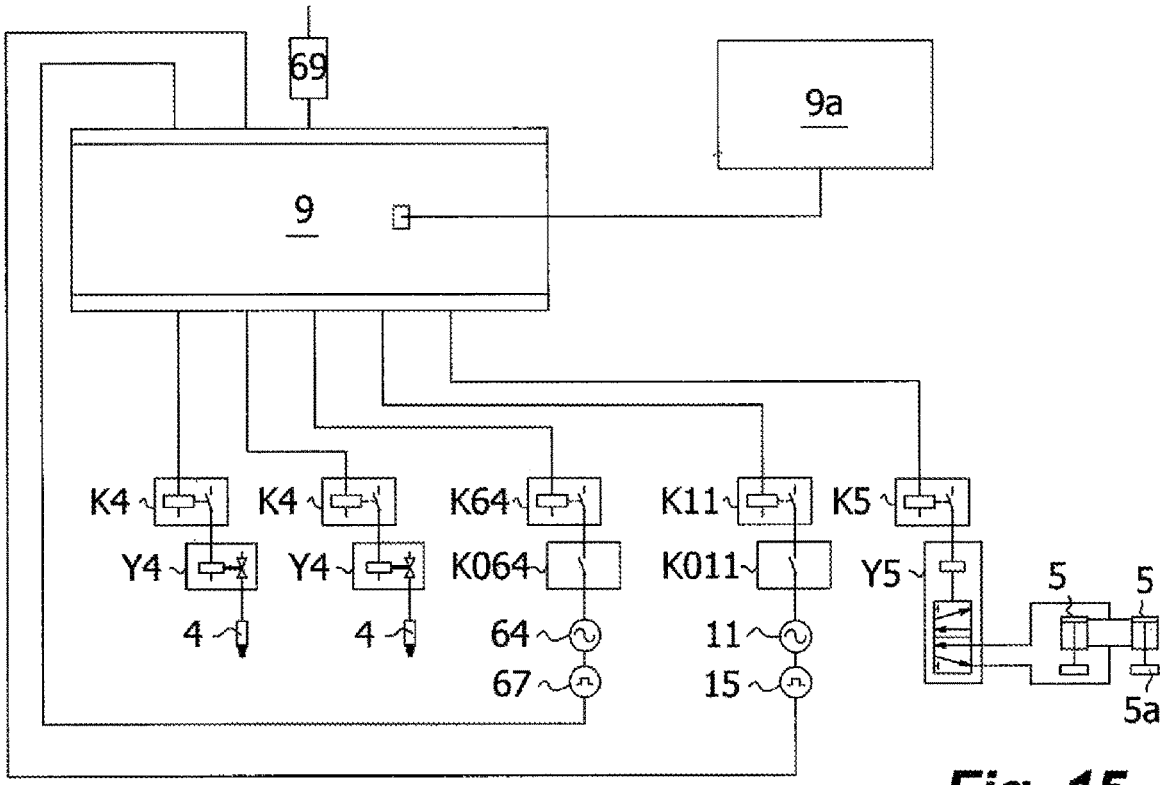
FIGS. 15 and 16 is an electrical schematic of the first and second embodiments of the machine, respectively, wherein the programmable controller device and the elements being connected thereof are represented, and wherein for the sake of clarity only two of the four glue injectors are represented.

FIG. 15 shows that the first and second rotary electric motors (11, 64), first and second rotational monitoring devices (15, 67), and the glue injectors (4) are connected to a programmable controller device (9) of the machine (100), embodied in a single PLC.

Alternatively, these elements can be connected in distributed form on several PLC, and one is these PLC (master) is the one which controls the rest (slaves). Going back to FIG. 15, each mold (50) further comprises two fluid-dynamic cylinders (5) connected to the programmable controller device (9) and configured to move each of them a respective box forming member (5*a*) of the mold (50), independently of the movements provided by the first and second rotary electric motor (11, 64).

Following in FIG. 1, the machine (100) has further associated two box nesting devices (3) (only one is shown in FIG. 1), one associated with each mold (50), each of which inserts a box (B), previously folded by said side faces (8) and said folding devices (52, 53), inside another, to contact the flat side walls (WL) of a box (B) with the flat side walls (WL) of other boxes (B) forming a stack of nested boxes.

The box nesting device (3) is additionally configured to, by this contact of flat side walls (WL) between boxes (B), pressing the glue cords (CC) previously applied by the corresponding two glue injectors (4), to reinforce the glue joint of the side walls (WL) which laterally surround the base (F) thereof. The side walls (WL) include the folded side panels (PL) and further include at the minor side walls the folded side flaps (SL).

Each box nesting device (3) is located below a respective cavity (51) of a respective mold (50) shown in FIG. 14, wherein an exit opening of the mold (50) is positioned.

Each box nesting device (3) comprises two formed boxes guides (3*a*) which hold the formed boxes (B) in a nested arrangement, together with each other, forming a stack of boxes (B) before exiting an exit opening of the lower part of the cavity (51).

In this first embodiment of FIG. 1, the formed box guides (3*a*) formed do not form an integral part of the mold (50) but are associated therewith, as they are located to receive the formed boxes (B) with inclined side walls from the mold (50). The formed box guides (3*a*) of FIG. 1 are not necessarily supported on the chassis (1) of the machine (100).

In an alternative embodiment (not shown), the two formed box guides (3*a*) may be supported on the chassis (1) forming an integral part of the mold (50) and located in the area of said exit opening of the mold (50).

In a second alternative embodiment (not shown), in the machine (100), said box nesting device (3) is configured to support the formed boxes (B), said box nesting device (3) being movable between a retracted position, wherein the surface of the exit opening associated with the mold (50) is greater to permit to fall a stack of nested formed boxes (B), and a support position, wherein the surface of the exit opening associated with the mold (50) is smaller to permit the support of a stack of nested formed boxes (B).

The machine (100) has regulations for adapting to different sizes and/or shapes and formats of plate (P) and box (B): the lateral guides (63) are adjustable in distance, the location of the at least one sucking element (94) in the suction head (94) is modifiable, the position of each of the pusher members (48) in the third position of delivery is adjustable relative to the guide support (44), the cavity (51) of the mold (50) is adjustable in two mutually perpendicular directions by two screws (56) and four clamps (54) able to be positioned along guide bridges (55), and the lower end connecting each of the vertical members (25) with the male (6) is vertically adjustable relative to a structural point of the carriage (23), for example, with respect to a crossbar (24) fixed to the carriage (23).

An example of the automatic cycle of operation of the machine is detailed below, although this has already been previously discussed.

Once the machine (100) has been regulated to the dimensions of the plate (P) to be supplied and the box (B) to be obtained, either of the loaders (62) or both are fed with flat plates (P) and the plates (P) are in an inclined arrangement between 15 and 25 degrees with respect to vertical.

Next, the sucker mechanism (99) moves the plates (P) from the first to the second position, and during this movement the pusher member (48) is positioned just behind the rear part of the plate (P) in a synchronized manner thanks to the driving engagement of the second electric motor (64).

Then, the second electric motor (64) continues rotating in a controlled manner by the rotational encoder (67), and imposes a linear horizontal movement to the flat plate (P), through the guiding device (45, 46) and the horizontal lateral guides (49) of plates of the conveyor of plates.

During this horizontal movement of the plate (P), the glue injectors (4) apply hot glue cords (CC) by pressure on the plate (P) as a function of the angle rotated by the second rotary electric motor (64) monitored by assembly of the second rotational encoder (67) and PLC.

For the application of the glue cords (CC), the PLC of FIG. 15 generates changing indicating signals and sends the signals to a relay (K4) associated with each glue injector (4), which in turn acts on the coil of a respective solenoid valve (Y4) for opening and closing the glue passage of a respective glue injector (4).

With the plate (P) in the third position disposed between a male (6) and a corresponding mold (50) and supported on a pair of horizontal lateral guides (49), the male (6) contacts the plate (P) at a moment pre-selected at will by the user through a touch screen (9*a*) connected to the PLC, thanks to the independence of the movement of the male device (10) by the first rotary electric motor (11), of the synchronized movement of the movable elements of the feeder which provides the second rotary electric motor (64).

When the plate (P) is inserted into the cavity (51) of the mold (50), portions of the plate (P) contact a plurality of folding devices (52, 53) to fold and join these portions with others and form a box (B), such as that shown in FIG. 4.

Said folding devices (52, 53), in cooperation with the inclined side faces (8) of the male (6), provide the box (B) said essentially inverted truncated pyramid shape.

With the male (6) in the maximum position of insertion, the box (B) has been folded and is then nested with other formed boxes (B) in a box nesting device (3), traversing an exit opening of the mold (50) in a nested arrangement, one with others, with the side walls (WL) of the boxes (B) in contact.

This operating cycle is repeated again for the formation of subsequent boxes (B) from plates (P).

In FIG. 15, the PLC can move or stop at will the first rotary electric motor (11), activating or deactivating an output connected to the relay (K11), which in turn, opens or closes the power contact (K011) associated with this first rotary electric motor (11).

Likewise, in FIG. 15, the PLC can move or stop at will the second rotary electric motor (64), activating or deactivating an output connected to the relay (K64), which in turn, opens or closes the power contact (K064) associated with this second rotary electric motor (64).

Also, in FIG. 15, the PLC can position at will the movable part of the pneumatic cylinders (5) at their rest or activation positions, activating or deactivating an output connected to the relay (K5), which, in turn, controls a solenoid valve (Y5) associated with the air passage to position the movable part of the cylinders (5) in one of said rest or activation positions. Thus, it is achieved the independency of the start or stop of the first and second rotary electric motors (11, 64), of the application of the glue cords (CC), and of the movement of the forming members (5*a*), with respect to the synchronized and controlled movement of the pusher members (48) and suction heads (93) of the feeder of plates.

Figure 16:
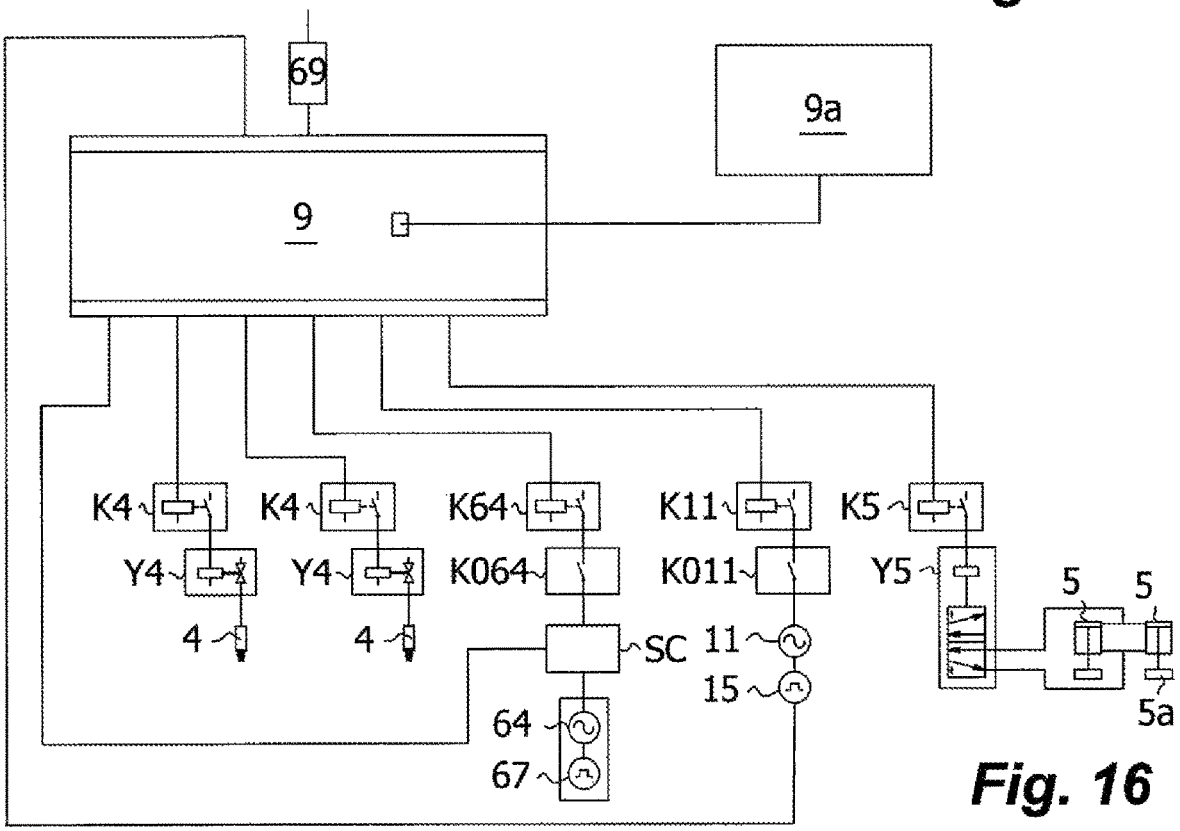

In the second embodiment of the machine (100), this comprises all elements and features of the first embodiment, except for that the second rotary electric motor (64) and the second rotational encoder (67) are integrated into a servomotor connected to a servomotor controller (SC), as shown in FIG. 16.

What is claimed is:

1. A machine (100) for forming cardboard boxes (B) from flat plates (P), comprising:

a feeder of plates, which comprises:

a loader (62) of plates with two lateral guides (63), one lateral guide (63) located on each side of the plates (P) capable of being supported on the loader (62), said loader (62) being configured to support the plates (P) with the faces of the plates (P) arranged vertically or with an inclination with respect to the vertical direction;

a sucker mechanism (99) which comprises a suction head (93) with at least one sucking element (94) configured to hold the plate (P), said suction head (93) being movable between a first position, wherein said suction head (93) is configured for individually holding by suction the plates (P) supported on the loader (62) by one of the faces of the plates (P), and a second position, wherein said suction head (93) is configured for positioning the plate (P) supported on two horizontal lateral guides (49) of plates of a conveyor of plates with that face hold by suction oriented upwards; and said conveyor of plates, which further comprises a pusher member (48) horizontally movable between the two horizontal lateral guides (49), these two horizontal lateral guides (49) and said pusher member (48) being configured to transport horizontally and in a guided manner the plates (P), one by one, from the second position, towards a third position wherein the plates (P) are aligned vertically and arranged between a male (5) and a mold (6) of a box forming station;

said box forming station, which comprises:

a male device (10) which comprises a first rotary electric motor (11), operatively coupled to a first rotational monitoring device (15) configured to directly or indirectly monitor an angle rotated by the first rotary electric motor (11), the male device (10) being configured to controllably and vertically move the male (6) in opposite directions of insertion and extraction with respect to a cavity (51) of said mold (50);

said male (6) provided with a lower base (7) of pressure configured to press a base (F) of the flat plate (P) located in the third position into the cavity (51); and said mold (50) which includes said cavity (51), and a plurality of folding devices (52, 53) delimiting a perimeter of the cavity (51) and providing the cavity (51) with a shape complementary to the base (F) of the box (B) to be formed, wherein the male (6) is insertable to fold and join portions of the plate (P) with others and form the box (B);

wherein the pusher member (48) of the conveyor of plates and the suction head (93) of the sucker mechanism (99) are both movable by a same second rotary electric motor (64) of the machine (100), the second rotary electric motor (64) being operatively coupled to a second rotational monitoring device (67) configured to directly or indirectly monitor an angle rotated by the second rotary electric motor (64); and wherein the first rotary electric motor (11), the second rotary electric motor (64), the first rotational monitoring device (15) and the second monitoring device (67) are jointly configured to controllably move the male (6), independently of the controlled and synchronized movement of the pusher member (48) and the suction head (93).

2. The machine (100) according to claim 1, wherein the male (6) has a plurality of side faces (8) with inclinations with respect to the vertical direction and converging towards the lower base (7), each of these side faces (8) being configured to fold a respective side panel (PL) of the plate (P);

wherein the machine (100) further comprises at least one glue injector (4), configured to deposit glue cords (CC) parallel to each other on the flat plate (P) during the horizontal movement of the pusher member (48), to join parts of the plate (P) with others by gluing; and wherein the second rotational monitoring device (67) includes a rotational encoder.

3. The machine (100) according to claim 2, wherein the machine (100) has further associated a box nesting device (3), configured to insert a box (B), previously folded by said side faces (8) and said folding devices (52, 53), inside another box (B), to contact flat side walls (WL) of a box (B) with flat side walls (WL) of other boxes (B), and the box nesting device (3) is configured to, by this contact of flat side walls (WL), press the glue cords (CC) previously applied by the at least one glue injector (4) to reinforce the glue joint of the side walls (WL), the side walls (WL) laterally surrounding the base (F) of the box (B), and the side walls (WL) including the folded side panels (PL).

4. The machine (100) according to claim 2, wherein the first rotary electric motor (11), the second rotary electric motor (64), the first rotational monitoring device (15), the second monitoring device (67), and the at least one glue injector (4) are connected to a programmable controller device (9) of the machine (100).

5. The machine (100) according to claim 3, wherein the first rotary electric motor (11), the second rotary electric motor (64), the first rotational monitoring device (15), the second monitoring device (67), and the at least one glue injector (4) are connected to a programmable controller device (9) of the machine (100).

6. The machine (100) according to claim 4, wherein the mold (50) further comprises fluid-dynamic cylinders (5) connected to the programmable controller device (9) and each of the fluid-dynamic cylinders (5) is configured to move a respective box forming member (5*a*) of the mold (50), independently of the movements provided by the first rotary electric motor (11) and the second rotary electric motor (64).

7. The machine (100) according to claim 5, wherein the mold (50) further comprises fluid-dynamic cylinders (5) connected to the programmable controller device (9) and each of the fluid-dynamic cylinders (5) is configured to move a respective box forming member (5*a*) of the mold (50), independently of the movements provided by the first rotary electric motor (11) and the second rotary electric motor (64).

8. The machine (100) according to claim 2, further comprising another loader (62) of plates, and another male (6) corresponding to another mold (50) in the box forming station, supported on a same chassis (1) of the machine (100); and wherein the sucker mechanism (99) comprises another suction head (93), each of said two suction heads (93) is movable between respective first positions and second positions, each of said two suction heads (93) is configured for individually suctioning respective plates (P) supported on a respective loader (62), and each of said two suction heads (93) is configured for positioning respective plates (P) supported on said two horizontal lateral guides (49) of plates (P) and on another two horizontal lateral guides (49) of plates (P) of the conveyor of plates, respectively;

wherein the conveyor of plates comprises said four horizontal lateral guides (49), said pusher member (48) and another pusher member (48), each of the two pusher members (48) being movable between a respective pair of said horizontal lateral guides (49), each pair of horizontal lateral guides (49) and pusher member (48) associated with said pair of horizontal lateral guides (49) being configured to transport horizontally and in a guided manner the plates (P), one by one, from respective second positions, towards respective third positions wherein each of the plates (P) are vertically aligned and arranged between one of said two males (6) and one of said two molds (50), correspondingly;

wherein said two pusher members (48) and said two suction heads (93) are movable by the second rotary electric motor (64); and wherein the first rotary electric motor (11), the second rotary electric motor (64), the first rotational monitoring device (15) and the second rotational monitoring device (67) are jointly configured to controllably move said two males (6) independently of the controlled and synchronized movement of the two pusher members (48) and the two suction heads (93).

9. The machine (100) according to claim 1, further comprising another loader (62) of plates, and another male (6) corresponding to another mold (50) in the box forming station, supported on a same chassis (1) of the machine (100);

wherein the sucker mechanism (99) comprises another suction head (93), each of said two suction heads (93) is movable between respective first positions and second positions, each of said two suction heads (93) is configured for individually suctioning respective plates (P) supported on a respective loader (62), and each of said two suction heads (93) is configured for positioning respective plates (P) supported on said two horizontal lateral guides (49) of plates (P) and on another two horizontal lateral guides (49) of plates (P) of the conveyor of plates, respectively;

wherein the conveyor of plates comprises said four horizontal lateral guides (49), said pusher member (48) and another pusher member (48), each of the two pusher members (48) being movable between a respective pair of said horizontal lateral guides (49), each pair of horizontal lateral guides (49) and pusher member (48) associated with said pair of horizontal lateral guides (49) being configured to transport horizontally and in a guided manner the plates (P), one by one, from respective second positions, towards respective third positions wherein each of the plates (P) are vertically aligned and arranged between one of said two males (6) and one of said two molds (50), correspondingly;

wherein said two pusher members (48) and said two suction heads (93) are movable by the second rotary electric motor (64); and wherein the first rotary electric motor (11), the second rotary electric motor (64), the first rotational monitoring device (15) and the second rotational monitoring device (67) are jointly configured to controllably move said two males (6), independently of the controlled and synchronized movement of the two pusher members (48) and the two suction heads (93).

10. The machine (100) according to claim 3, further comprising another loader (62) of plates, and another male (6) corresponding to another mold (50) in the box forming station, supported on a same chassis (1) of the machine (100);

wherein the sucker mechanism (99) comprises another suction head (93), each of said two suction heads (93) is movable between respective first positions and second positions, each of said two suction heads (93) is configured for individually suctioning respective plates (P) supported on a respective loader (62), and each of said two suction heads (93) is configured for positioning respective plates (P) supported on said two horizontal lateral guides (49) of plates (P) and on another two horizontal lateral guides (49) of plates (P) of the conveyor of plates, respectively;

wherein the conveyor of plates comprises said four horizontal lateral guides (49), said pusher member (48) and another pusher member (48), each of the two pusher members (48) being movable between a respective pair of said horizontal lateral guides (49), each pair of horizontal lateral guides (49) and pusher member (48) associated with said pair of horizontal lateral guides (49) being configured to transport horizontally and in a guided manner the plates (P), one by one, from respective second positions, towards respective third positions wherein each of the plates (P) are vertically aligned and arranged between one of said two males (6) and one of said two molds (50), correspondingly;

wherein said two pusher members (48) and said two suction heads (93) are movable by the second rotary electric motor (64); and wherein the first rotary electric motor (11), the second rotary electric motor (64), the first rotational monitoring device (15) and the second rotational monitoring device (67) are jointly configured to controllably move said two males (6), independently of the controlled and synchronized movement of the two pusher members (48) and the two suction heads (93).

11. The machine (100) according to claim 6, further comprising another loader (62) of plates, and another male (6) corresponding to another mold (50) in the box forming station, supported on a same chassis (1) of the machine (100);

wherein the sucker mechanism (99) comprises another suction head (93), each of said two suction heads (93) is movable between respective first positions and second positions, each of said two suction heads (93) is configured for individually suctioning respective plates (P) supported on a respective loader (62), and each of said two suction heads (93) is configured for positioning respective plates (P) supported on said two horizontal lateral guides (49) of plates (P) and on another two horizontal lateral guides (49) of plates (P) of the conveyor of plates, respectively;

wherein the conveyor of plates comprises said four horizontal lateral guides (49), said pusher member (48) and another pusher member (48), each of the two pusher members (48) being movable between a respective pair of said horizontal lateral guides (49), each pair of horizontal lateral guides (49) and pusher member (48) associated with said pair of horizontal lateral guides (49) being configured to transport horizontally and in a guided manner the plates (P), one by one, from respective second positions, towards respective third positions wherein each of the plates (P) are vertically aligned and arranged between one of said two males (6) and one of said two molds (50), correspondingly;

wherein said two pusher members (48) and said two suction heads (93) are movable by the second rotary electric motor (64); and wherein the first rotary electric motor (11), the second rotary electric motor (64), the first rotational monitoring device (15) and the second rotational monitoring device (67) are jointly configured to controllably move said two males (6), independently of the controlled and synchronized movement of the two pusher members (48) and the two suction heads (93); and wherein each of the two molds (50) further comprises said fluid-dynamic cylinders (5) connected to the programmable controller device (9) and each of the fluid-dynamic cylinders (5) is configured to move said respective box forming member (5*a*) of the mold (50), independently of the movements provided by the first rotary electric motor (11) and the second rotary electric motor (64).

12. The machine (100) according to claim 8, wherein the machine (100) has further associated two box nesting devices (3), each of said box nesting device (3) associated with one of said molds (50), and each of said box nesting device (3) inserts a box (B), previously folded by said side faces (8) of one of said males (6) and folding devices (52, 53) of one of said molds (50), inside another, to contact the flat side walls (WL) of a box (B) with the flat side walls (WL) of other boxes (B) forming a stack of nested boxes (B).

13. The machine (100) according to claim 12, wherein each box nesting device (3) is located below a cavity (51) of a mold (50) wherein an exit opening of the mold (50) is positioned; and wherein each box nesting device (3) comprises two formed boxes guides (3*a*), the two box forming guides (3*a*) being configured for holding the boxes (B) in a nested arrangement, together with each other, forming said stack of boxes (B), before exiting said exit opening located in a lower part of the cavity (51).

14. The machine (100) according to claim 2, wherein the loader (62) is configured to support the plates (P) with the faces thereof with an inclination with respect to the vertical direction comprised between 10 and 30 degrees.

15. The machine (100) according to claim 3, wherein the loader (62) is configured to support the plates (P) with the faces thereof with an inclination with respect to the vertical direction comprised between 10 and 30 degrees.

16. The machine (100) according to claim 8, wherein each of the two loaders (62) are configured to support plates (P) with the faces thereof with an inclination with respect to the vertical direction comprised between 10 and 30 degrees.

17. The machine (100) according to claim 11, wherein each of the two loaders (62) are configured to support plates (P) with the faces thereof with an inclination with respect to the vertical direction comprised between 10 and 30 degrees.

18. The machine (100) according to claim 1, wherein in the sucker mechanism (99), the second rotary electric motor (64) is configured to cause a rotation of at least one articulated bar (87) around at least one horizontal articulation (88), and said articulated bar (87) is, in turn, configured to cause a rotation of an inverted bar (89) around a second horizontal articulation (90).

19. The machine (100) according to claim 1, wherein the conveyor of plates comprises a connecting rod (41) directly or indirectly coupled at a proximal end thereof to the second rotary motor (64), and a horizontal guiding device (45, 46) is connected to a distal end of said connecting rod (41), said connecting rod (41) and said horizontal guiding device (45, 46) being configured to cause a forward and backward guiding of said pusher member (48) between the second position and third position.

20. The machine (100) according to claim 1, wherein the male device (10) further comprises:

two vertical linear guides (21) fixed at a structural point of a chassis (1) of the machine (100);

at least one guide block (22) configured for sliding in each vertical linear guide (21) and fixed to a carriage (23) configured for sliding along the two vertical linear guides (21);

said carriage (23) wherein at least one vertical member (25) is fixed, the at least one vertical member (25) supporting at the lower end thereof said male (6);

a horizontal transverse guide (19) mounted on the carriage (23); and a rotary crank (16) provided with a proximal end and a distal end, directly or indirectly joined by the proximal end to the first rotary electric motor (11), and pivotally joined by the distal end in an articulation (17) to an additional guide block (18) configured to slide in the horizontal transverse guide (19).

* * * * *